United States Patent [19]

Grundmann

[11] 4,122,756

[45] Oct. 31, 1978

[54] VAPOR ENGINE

[75] Inventor: Edgard Grundmann, Fallersleben, Fed. Rep. of Germany

[73] Assignee: Volkswagenwerk Aktiengesellschaft, Wolfsburg, Fed. Rep. of Germany

[21] Appl. No.: 762,453

[22] Filed: Jan. 25, 1977

[30] Foreign Application Priority Data

Jan. 29, 1976 [DE] Fed. Rep. of Germany ..... 2603249

[51] Int. Cl.[2] ..... F01B 1/02; F01B 19/00; F16J 3/04

[52] U.S. Cl. ..... 91/180; 92/37; 92/73; 417/473; 64/28 M

[58] Field of Search ..... 91/180; 64/28 M; 92/73; 417/473, 517, 519

[56] References Cited

U.S. PATENT DOCUMENTS

| | | | |
|---|---|---|---|
| 727,752 | 5/1903 | Crompton | 91/180 |
| 749,958 | 1/1904 | Crompton | 91/180 |
| 1,117,942 | 11/1914 | Bullard | 92/73 |
| 1,905,585 | 4/1933 | Giesler | 91/180 |
| 3,554,090 | 1/1971 | Wallace | 91/180 |

FOREIGN PATENT DOCUMENTS

| | | | |
|---|---|---|---|
| 427,185 | 11/1947 | Italy | 91/180 |
| 217,132 | 6/1924 | United Kingdom | 91/180 |

*Primary Examiner*—Paul E. Maslousky
*Attorney, Agent, or Firm*—Spencer & Kaye

[57] ABSTRACT

A vapor engine using a refrigerant as its working medium and having a number of bellows each forming an expansion chamber which receives the working medium and changing its volume under the influence of the pressure exerted by the vaporized working medium. A crank shaft is arranged above and is mechanically connected to each of the bellows, and a rotary slide is provided below the bellows for controlling the flow of the working medium to and from the bellows.

7 Claims, 7 Drawing Figures

VAPOR ENGINE

BACKGROUND OF THE INVENTION

The present invention relates to a steam or vapor engine which uses a refrigerant as its working medium and which is provided with a number of bellows each forming an expansion chamber for receiving the working medium and changing its volume under the influence of the pressure exerted by the vaporized working medium. Engines of this type are provided with a crank shaft from which mechanical power can be taken off as well as with valves which serve to control the flow of the working medium to the interior of the bellows.

One type of working medium which is particularly suited for use in such engines is a refrigerant known commercially as a freon, which is a halogenated hydrocarbon and particularly halogenated methane or ethane. Such refrigerants are not inherently dangerous, they do not react chemically to any significant extent with the seals with which engines of this type are equipped, and they have relatively low temperatures of vaporization, so that it is practical to use such refrigerants as the working medium for the purpose of obtaining kinetic energy even if operating conditions are such that only relatively small temperature differences are available. A vapor-type engine according to the present invention can therefore be used in a system which incorporates two heat exchangers, one of which is a solar heat exchanger that serves to heat up water by means of solar energy and to vaporize the refrigerant, the second heat exchanger being one which is connected to the medium outlet of the engine and which, with the help of water which is itself at normal temperature, e.g., at an ambient or room temperature of between 20° to 25° C., condenses the refrigerant coming from the engine. If desired, a circulating pump can be inserted between the refrigerant output of the second heat exchanger and the refrigerant input of the first heat exchanger. The foregoing is, of course, but one exemplary application for a vapor engine of the type involved here.

While a vapor engine using a refrigerant as its working medium makes it possible to utilize small temperature differences, considerable care has to be taken in properly designing the engine. For one thing, the vapor pressure exerted by the refrigerant will usually be relatively small, so that the engine should operate with as little friction as possible. Consequently, it is not always readily possible to let the expansion chambers be constituted by conventional piston-and-cylinder arrangements. For this reason, as well as in view of the relatively small amount of input energy available for such vapor engines, one cannot do with conventional valves and valve actuating arrangements. Moreover, while it is true that refrigerants consisting of halogenated hydrocarbons will liberate lubricants that are useful to lubricate the various component parts of the engine and which will penetrate even into small spaces, the very fact that such fine lubricants are present bring various sealing problems with them. Moreover, suitable provision has to be made for draining the lubricating oils when the engine is shut down, and for lubricating oils which are carried along by condensation formed as the result of expansion in the wet vapor phase.

It is, therefore, the primary object of the present invention to provide a vapor engine of the above-described type which allows the use of modern refrigerants as its working medium, which is of uncomplicated structure, and which is able to fulfill the above-stated criteria.

BRIEF DESCRIPTION OF THE INVENTION

With the above objects in view, the present invention resides in a vapor engine of the above type which uses a refrigerant as its working medium, in which the flow of the refrigerant is controlled by a rotary slide and in which the expansion chambers are constituted by bellows which are arranged below the crank shaft but above the rotary slide.

Thanks to such an arrangement, there is obtained a vapor engine which makes use of a flow control arrangement operating with very little friction. This is of special importance in vapor engines, far more so than in the case of internal combustion engines in which the use of various types of rotary slides is known. Moreover, the use of bellows-type expansion chambers, known for example in pumps forming part of gas analysis equipment, provides a component which is practically frictionless. The bellows are particularly suited for use in this environment, considering the relatively low pressures exerted by the working medium, which means that the bellows will remain intact and possess excellent sealing characteristics, thus assuring long periods of troublefree operation. Finally, thanks to the fact that the bellows are arranged below the crank shaft but above the rotary slide, any condensate formed within the vapor engine will be carried away automatically, so that no additional or special means are needed for this purpose.

DETAILED DESCRIPTION OF THE PREFERRED EMBODIMENTS

Figure 1:
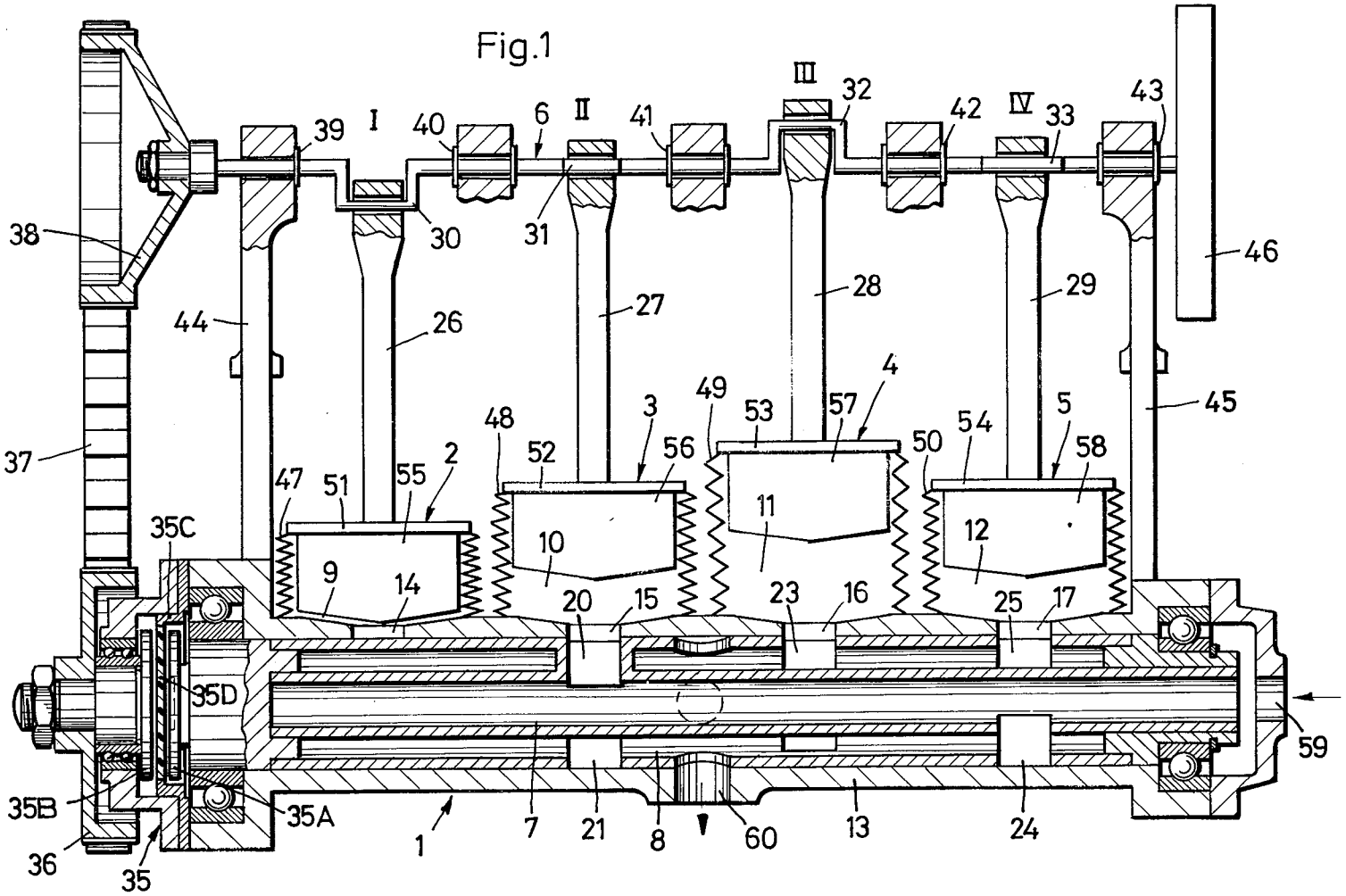
FIG. 1 is a longitudinal sectional view of a vapor engine according to the present invention. The engine shown is one having four expansion chambers, the cross sectional plane of the chambers being indicated at I, II, III and IV, respectively.

Referring now to the drawings, the same show a vapor engine according to the present invention which incorporate three principal components, namely, the rotary slide means 1 which control the flow of the working medium, i.e., the halogenated hydrocarbon, to the expansion chambers in which the thermodynamic properties of the working medium are transformed into mechanical motion; the bellows 2, 3, 4, 5; and the crank shaft 6 which is mechanically connected to the bellows and which converts their reciprocatory movement into rotational movement. These three principal components are, as shown in FIG. 1, arranged one above another in the sequence just recited, i.e., the crank shaft 6 is above the line of bellows 2 to 5 and the rotary slide means 1 are arranged below the bellows, thus facilitating the drainage of any condensate formed in the bellows.

Considering first the mechanical configuration of the rotary slide means, the same comprises a stationary outer housing 13 having four radial ports or channels 14, 15, 16, 17, each of which is axially aligned with a respective bellows 2, 3, 4, 5, designated as bellows I, II, III and IV, respectively; a downwardly directed radial outlet 60 for the working medium; and an inner slide chamber. The rotary slide means further comprises an inner slide member which is mounted for rotation within the inner slide chamber. The inner slide member has a disc-shaped central cross-sectional region 7 and an arcuate outer cross-sectional region 8. Each arcuate outer cross-sectional region is divided into a plurality of segments corresponding in number to the number of bellows, and as shown best in FIGS. 1 and 4 to 7, each segment is axially aligned with a respective one of the bellows, the segments being radially staggered with respect to each other. The inner region 7 of the slide member is provided with four radial passages 18, 20, 22 and 24 and the outer region 8 is provided with four radial passages 19, 21, 23 and 25, the axial arrangement of the passages being such that the passages 18, 19 are in axial alignment with the radial channel 14 which lies in the plane of the I bellow and places the slide chamber in communication with the interior of this bellow. Similarly, the passages 20, 21 are in axial alignment with the second radial channel 15 associated with the II below, the passages 22, 23 are in axial alignment with the third radial channel 16 associated with the III bellow, and the passages 24, 25 are in axial alignment with the fourth radial channel 17 associated with the IV bellow.

The interaction between the rotary slide means and the bellows will be described below.

Reverting to the structure of the bellows 2, 3, 4, 5, each comprises a respective metallic element 47, 48, 49, 50 which may, in practice, be constituted by a series of welded-together metallic rings, each element surrounding the respective radial channel 14, 15, 16, 17. Each bellow is in sealing-tight engagement with the exterior of the tubular housing 13 of the rotary slide means, and the top of each bellow element is sealed off by a respective piston plate 51, 52, 53, 54, each of which carries a respective piston element 55, 56, 57, 58, which projects into the interior of each respective bellow element. The interior of each bellow element, shown at 9, 10, 11, 12, respectively, is thus effectively sealed off with respect to the exterior. This type of bellows arrangement has a number of practical advantages; among them are that they will remain tightly sealed, that there will be little loss of energy, and that they will give long periods of troublefree service, especially when they are subjected to the relatively low pressures which will be exerted when the engine uses modern refrigerants operated over a relative small temperature range.

Figures 2, 3, 4, 5, 6, 7:
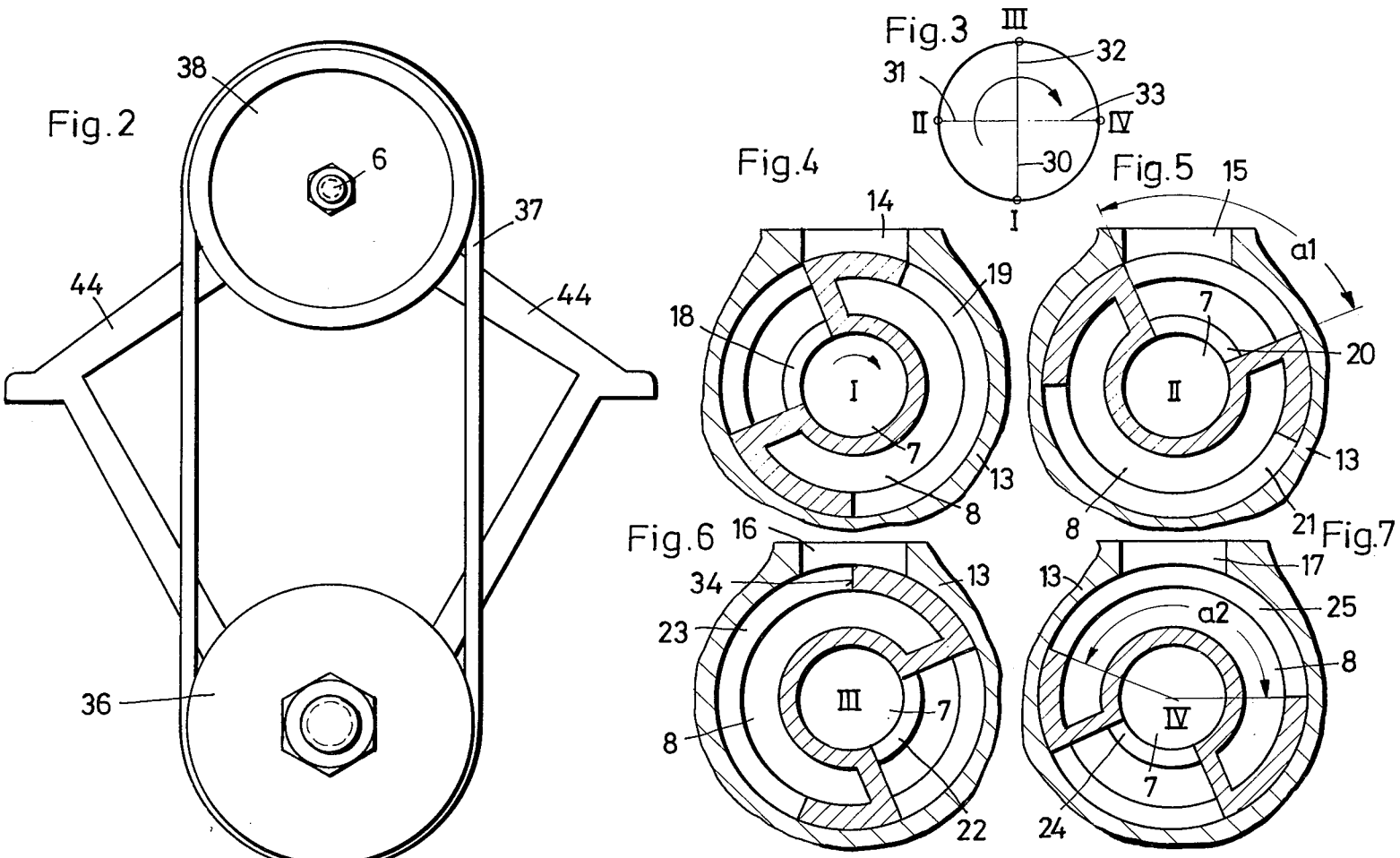
FIG. 2 is an elevational view showing one end of the engine.
FIG. 3 is a schematic end view of the crank shaft, showing the positions of the individual crank pin portions associated with the respective expansion chambers. Each crank pin is denoted by I, II, III and IV, respectively, to reflect its association with a respective expansion chamber.
FIGS. 4, 5, 6 and 7 are cross sectional views taken in planes I, II, III and IV, respectively, showing, inter alia, the configuration of the rotary slide in the region of each of these cross sectional planes.

Arranged at the top of the engine is the crank shaft 6, the positions of whose crank pins 30, 31, 32, 33 associated with the I, II, III and IV bellows are shown structurally in FIG. 1 and diagramatically in FIG. 2. The mechanical connection between the crank shaft 6 and the bellows is provided by the piston rods 26, 27, 28, 29, which are connected with the respective piston plates 51, 52, 53, 54, respectively. The crank shaft 6 itself is supported, for example, by five bearings 39, 40, 41, 42, 43, which may be conventional roller bearings mounted in conventional support frames. In the interest of simplicity, only the two end frames 44 and 45 arranged at the two opposite ends of the engine are shown.

The right-hand end of the crank shaft is shown as being provided with a pulley 46 from which rotational kinetic energy may be taken off the engine.

The axes of rotation of the crank shaft 6 and of the inner slide member are generally parallel to each other, and these parts are rotationally connected to each other. This rotational connection is established by way of a toothed wheel or sprocket wheel 38 which is mounted on the left-hand end of the crank shaft 6 and which is force-transmittingly connected by way of a toothed belt or sprocket chain 37 to a second toothed wheel or sprocket wheel 36 which itself is connected to the left-hand end of the inner slide member of the rotary slide means 1. In this way, the rotation of the slide member is synchronized with that of the crank shaft 6.

The connection between the toothed or sprocket wheel 36 and the inner slide member comprises a magnetic coupling having two parts 35 A and 35 B which are magnetically coupled for rotation with each other, one of these parts being connected to the slide member and the other being located exteriorly of the engine casing 35 C. A sealing portion 35 D is provided which passes between the two magnetically coupled parts and which fluid-tightly seals the engine casing. In practice, the sealing portion will be made of plastic or other material which allows the flow of magnetic flux between the two magnetically coupled parts.

Furthermore, there is a working medium inlet 59 which is arranged at the right end of the engine and communicates with the right end of the rotary slide means 1. The arrangement of the parts provides an adequate seal for the rotary slide means, that is to say, for the gap between the inner surface of the slide chamber of housing 13 and the outer surface of the rotary slide member. In practice, no special sealing problems will arise, thanks to the lubricating oils which are liberated from the working medium, these lubricating oils serving not only as lubricants but also to seal the gap.

Of course, the toothed or sprocket wheel 36 can also be directly fixed to the left end of the inner slide member, and a ringshaped cover plate may be used for sealing purposes.

The operation of the engine will best be understood by referring to FIGS. 1 and 4 to 7, which likewise show the structural arrangement of the rotary inner slide member and especially the configuration of the cross-sectional regions 7 and 8 and the manner in which the radial passages associated therewith coact with the channels 14, 15, 16, 17 leading to the four bellows. FIGS. 4 to 7 show the configuration of the inner slide member while it occupies the position given to it by the crank shaft 6, through the intermediary of the parts 36, 37, 38 which synchronize the rotation of the crank shaft 6 and the slide member. Thus, insofar as the I bellow is concerned, neither of the radial passages 18, 19 communicates with the radial channel 14 leading to it, as shown in FIG. 4. However, the II bellow will, as shown in FIG. 5, be filled with the working medium entering via inlet 59 inasmuch as the radial passage 20 of the inner region 7 of the slide member is in communication with the channel 15 leading to the interior of the II bellow. The inner region 7 of the slide will remain in communication with the channel 15 while the slide is rotated, in clockwise direction as viewed in the drawings, through the angle al. As for the III bellow, however, its filling cycle will already have been completed, see FIG. 6, and the trailing control edge 34 of passage 23 will already have started to uncover the channel 16, so the working medium will already have started to flow out the interior of the III bellows. The arc of the passage 23 is so large that working medium exhaust cycle, which the IV bellow is undergoing at this time, see FIG. 7, is still far from having been ended.

The angular extent of each of the radial passages 18, 20, 22, 24 communicating with the central region 7 is al, as shown in FIG. 5, whereas the angular extent of each of the radial passages 19, 21, 23, 25 communicating with the outer region 8 is a2, as shown in FIG. 7. It will thus be seen that each expansion chamber will be subject to a succession of cycles, namely, a charging cycle, during which it is filled with the refrigerant, a work cycle during which the closed chamber is subjected to the pressure of the vaporized refrigerant, and an exhaust cycle.

In the above-described embodiment, there is but a single rotary slide means for allowing the flow of refrigerant both to and from the expansion chambers. This will, in general, be sufficient. However, it is conceivable that the provision of such a single slide will, particularly if the engine incorporates a relatively large number of expansion chambers, cause excessive flow resistance for the refrigerant. This may, in accordance with a further feature of the present invention, be avoided by providing separate slide arrangements, one for supplying the working medium to the bellows and one for carrying the working medium away.

The engine according to the present invention may use, as its working medium, any suitable halogenated hydrocargon, as for example, a freon which is halogenated methane or ethane such as trichloromonofluoromethane ($CCl_3F$), dichlorodifluoromethane ($CCl_2F_2$), monochlorotrifluoromethane ($CClF_3$), dichloromonofluoromethane ($CHCl_2F$), monochlorodifluoromethane ($CHClF_2$), trichlorotrifluoroethane ($CCl_2FCClF_2$), or dichlorotetrafluoroethane ($C_2Cl_2F_4$).

It will be understood that the above description of the present invention is susceptible to various modifications, changes and adaptations, and the same are intended to be comprehended within the meaning and range of equivalents of the appended claims.

What is claimed is:

1. A vapor engine using a refrigerant as its working medium, said engine comprising:

(a) a plurality of bellows each forming an expansion chamber for receiving the working medium, each of said expansion chambers changing its volume under the influence of the pressure exerted by the vaporized working medium;

(b) a crank shaft arranged above and mechanically connected to each of said bellows;

(c) rotary slide means arranged below said bellows for controlling the flow of the working medium to and from said bellows;

(d) said crank shaft and rotary slide means extending between two opposite ends of the engine, the axes of rotation of said crank shaft and said rotary slide means being generally parallel to each other;

(e) means arranged at one of said ends for connecting said crank shaft and rotary slide means for synchronous rotation with each other; and (f) said engine having a casing and said means for rotationally connecting said crank shaft and said rotary slide means to each other including a magnetic coupling having two parts which are magnetically coupled for rotation with each other as well as a sealing portion which passes between said two magnetically coupled parts and which fluid-tightly seals the engine casing, said sealing portion being made of a material which allows the flow of magnetic flux between said two magnetically coupled parts.

2. An engine as defined in claim 1, further comprising refrigerant inlet means communicating with said rotary slide means.

3. An engine as defined in claim 2, wherein said inlet means are arranged in the region of the other end of said engine and therefore at that end of said slide means which is opposite to the end at which it is rotationally connected to said crank shaft.

4. An engine as defined in claim 1, wherein said rotary slide means comprises two separate slide arrangements, one for supplying the working medium to said bellows and the other for carrying the working medium away from said bellows.

5. An engine as defined in claim 1, wherein said rotary slide means comprise a stationary outer housing having a slide chamber and an inner slide member mounted for rotation within said slide chamber of said outer housing, said outer housing having a plurality of channels each lying in the plane of a respective one of said bellows, each channel communicating with said slide chamber as well as with the interior of its respective bellow, said inner slide member having a disc-shaped central cross-sectional region and an arcuate outer cross-sectional region, said regions having radial passages communicating with said channels and serving to allow the flow of refrigerant to and from said bellows.

6. An engine as defined in claim 5, wherein said arcuate outer cross-sectional region is divided into a plurality of segments corresponding in number to the number of bellows, each segment being axially aligned with a respective one of said bellows, said segments being radially staggered with respect to each other.

7. An engine as defined in claim 6, wherein said stationary outer housing of said rotary slide means is provided with refrigerant outlet means communicating with said slide chamber.

* * * * *